US005405417A

United States Patent [19]

Cunningham

[11] Patent Number: 5,405,417

[45] Date of Patent: Apr. 11, 1995

[54] FUEL COMPOSITIONS WITH ENHANCED COMBUSTION CHARACTERISTICS

[75] Inventor: Lawrence J. Cunningham, Kirkwood, Mo.

[73] Assignee: Ethyl Corporation, Richmond, Va.

[21] Appl. No.: 153,473

[22] Filed: Nov. 16, 1993

Related U.S. Application Data

[63] Continuation of Ser. No. 552,893, Jul. 16, 1990, abandoned.

[51] Int. Cl.[6] ..... C10L 1/22; C10L 1/18

[52] U.S. Cl. ..... 44/322; 44/326

[58] Field of Search ..... 44/322, 413, 423, 326

[56] References Cited

U.S. PATENT DOCUMENTS

| | | | |
|---|---|---|---|
| 2,031,497 | 2/1936 | Marvel | 44/9 |
| 2,107,059 | 2/1938 | Moser | 44/77 |
| 2,158,050 | 6/1939 | Bereslavsky | 44/9 |
| 2,174,680 | 10/1939 | Badertscher et al. | 44/9 |
| 2,280,217 | 4/1942 | Cloud | 44/9 |
| 2,324,779 | 7/1943 | Kass | 44/69 |
| 2,481,859 | 9/1949 | Miller | 44/322 |
| 2,516,649 | 7/1950 | Rust et al. | 260/610 |
| 2,523,672 | 9/1950 | Wilder | 44/57 |
| 2,567,615 | 9/1951 | Milas | 260/453 |
| 2,618,650 | 11/1952 | Hinkamp et al. | 260/467 |
| 2,655,440 | 10/1953 | Barusch et al. | 44/57 |
| 2,698,512 | 1/1955 | Schirmer et al. | 60/35.4 |
| 2,763,537 | 9/1956 | Barusch et al. | 44/57 |
| 2,905,540 | 9/1959 | Von Schickh et al. | 44/57 |
| 2,912,313 | 11/1959 | Hinkamp et al. | 44/57 |
| 3,001,857 | 9/1961 | Pollock | 44/57 |
| 3,082,236 | 3/1963 | Mageli et al. | 260/453 |
| 3,415,632 | 12/1968 | Rechberger | 44/74 |
| 3,732,283 | 5/1973 | Cummings | 260/466 |
| 4,045,188 | 8/1977 | Hirschey | 44/77 |
| 4,073,626 | 2/1978 | Simmons | 44/57 |
| 4,104,036 | 8/1978 | Chao et al. | 44/68 |
| 4,185,594 | 1/1980 | Perilstein | 123/1 A |
| 4,240,801 | 12/1980 | Desmond, Jr. | 44/57 |
| 4,248,182 | 2/1981 | Malec | 44/411 |
| 4,328,005 | 5/1982 | Frankel et al. | 44/57 |
| 4,330,304 | 5/1982 | Gorman | 44/63 |
| 4,332,740 | 6/1982 | Kato et al. | 260/453 RZ |
| 4,354,855 | 10/1982 | Sweeney | 44/77 |
| 4,417,903 | 11/1983 | Hinkamp | 44/53 |
| 4,448,587 | 5/1984 | Hinkamp et al. | 44/57 |
| 4,455,252 | 6/1984 | Wylegala et al. | 44/7.5 |
| 4,482,352 | 11/1984 | Osgood et al. | 44/77 |
| 4,514,286 | 4/1985 | Wang et al. | 44/50 |
| 4,525,308 | 6/1985 | Sanchez | 260/453 RZ |
| 4,549,883 | 10/1985 | Purcell et al. | 44/57 |
| 4,561,862 | 12/1985 | Dory | 44/57 |
| 4,857,073 | 8/1989 | Vataru et al. | 44/57 |

FOREIGN PATENT DOCUMENTS

| | | | |
|---|---|---|---|
| 0638054 | 3/1962 | Canada . | |
| 0080314 | 11/1981 | European Pat. Off. | 77/2 |
| 0338599 | 10/1989 | European Pat. Off. | 1/22 |
| 599132 | 3/1948 | United Kingdom . | |
| 628347 | 8/1949 | United Kingdom . | |
| 673125 | 6/1952 | United Kingdom . | |
| 0697730 | 9/1953 | United Kingdom . | |

OTHER PUBLICATIONS

*Encylopedia of Polymer Science and Engineering,* vol. 11, John Wiley & Sons, (1988) (no month available) "Peroxy Compounds to Polyesters".

A Wiley–Interscience Publication (John Wiley & Sons), Kirk–Othmer *Encyclopedia Of Chemical Technology,* Third Edition, vol. 17, "Peroxides and Peroxy Compounds, Inorganic To Piping Systems", pp. 28, 37. 73. 77 (no month provided) 1988.

*Oil And Gas Journal,* vol. 85, No. 15, "Higher Severity HDT Needed For Low–Sulfur Diesel", pp. 33–38, (1987) (No month available).

*Primary Examiner*—Margaret Medley

*Attorney, Agent, or Firm*—Dennis H. Rainear; William H. Thrower

[57] ABSTRACT

Fuels, methods of producing fuels, and methods of using fuels to reduce the amount of atmospheric pollutants (NOx, CO, and/or hydrocarbons) formed on combustion of middle distillate fuels in engines or burner apparatus. These results can be achieved without concomitant increases in emissions of particulates. The fuels contain less than 500 ppm of sulfur and at least one peroxy ester combustion improver.

22 Claims, No Drawings

FUEL COMPOSITIONS WITH ENHANCED COMBUSTION CHARACTERISTICS

This application is a continuation of Ser. No. 07/552,893, filed Jul. 16, 1990, now abandoned.

This invention relates to preservation of the environment. More particularly, this invention relates to fuel compositions and methods that reduce atmospheric pollution normally caused by the operation of engines or combustion apparatus on middle distillate fuels.

The importance and desirability of reducing the release of pollutants into the atmosphere are well recognized. Among the pollutants sought to be reduced are nitrogen oxides ("$NO_x$") carbon monoxide, unburned hydrocarbons, and particulates.

This invention involves the discovery, inter alia, that it is possible to reduce the amount of $NO_x$ or CO or unburned hydrocarbons released into the atmosphere during operation of engines or other combustion apparatus operated on middle distillate fuel by employing as the fuel a middle distillate fuel having a sulfur content of 500 ppm or less and having dissolved therein a combustion improving amount of at least one peroxy ester combustion improver. In fact it has been found possible through use of such fuel compositions to reduce the amount of two and in some cases all three such pollutants ($NO_x$, CO and unburned hydrocarbons) emitted by diesel engines. Moreover this important and highly desirable objective has been and thus may be achieved without suffering an undesirable increase in the emission of particulates. This is a unique discovery since the available experimental evidence and mechanistic theories of combustion suggest that if $NO_x$ is reduced, the amount of particulates will be increased, and vice versa.

Accordingly this invention provides in one of its embodiments a fuel composition characterized in that it comprises a major proportion of a hydrocarbonaceous middle distillate fuel which has a sulfur content of less than 500 ppm (preferably 100 ppm or less and most preferably no more than 60 ppm) and in that said fuel contains a minor combustion-improving amount of at least one peroxy ester combustion improver dissolved therein. By the term "hydrocarbonaceous" as used in the ensuing description and appended claims is meant the middle distillate fuel is composed principally or entirely of fuels derived from petroleum by any of the usual processing operations. The finished fuels may contain, in addition, minor amounts of non-hydrocarbonaceous fuels or blending components such as alcohols, dialkyl ethers, or like materials, and/or minor amounts of suitably desulfurized auxiliary liquid fuels of appropriate boiling ranges (i.e., between about 160° and about 370° C.) derived from tar sands, shale oil or coal. When using blends composed of such desulfurized auxiliary liquid fuels and hydrocarbonaceous middle distillate fuels, the sulfur content of the total blend must be kept below 500 ppm.

In another of its embodiments this invention provides improvements in combustion processes wherein a hydrocarbonaceous middle distillate fuel is subjected to combustion in the presence of air. Such improvement comprises providing as a fuel used in such process a hydrocarbonaceous middle distillate fuel having a sulfur content of less than 500 ppm (preferably 100 ppm or less and most preferably no more than 60 ppm) and having dissolved therein a minor combustion improving amount of at least one peroxy ester combustion improver.

Still another embodiment of this invention provides improvements in the production of hydrocarbonaceous middle distillate fuels. Such improvements comprise controlling or reducing the sulfur content of the fuel to a level of 500 ppm or less (preferably 100 ppm or less and most preferably no more than 60 ppm) and blending peroxy ester combustion improver with the resultant reduced sulfur-containing fuel.

Additional embodiments of this invention involve improvements in the operation of motor vehicles and aircraft which operate on middle distillate fuels. These improvements involve fueling the vehicle or aircraft with a hydrocarbonaceous middle distillate fuel characterized by having a sulfur content of less than 500 ppm (preferably 100 ppm or less and most preferably no more than 60 ppm) and containing a minor combustion-improving amount of at least one peroxy ester combustion improver dissolved therein.

These and other embodiments are set forth in the ensuing description and appended claims.

The hydrocarbonaceous fuels utilized in the practice of this invention are comprised in general of mixtures of hydrocarbons which fall within the distillation range of about 160° to about 370° C. Such fuels are frequently referred to as "middle distillate fuels" since they comprise the fractions which distill after gasoline. Such fuels include diesel fuels, burner fuels, kerosenes, gas oils, jet fuels, and gas turbine engine fuels.

Preferred middle distillate fuels are those characterized by having the following distillation profile:

| | °F. | °C. |
|---|---|---|
| IBP | 250–500 | 121–260 |
| 10% | 310–550 | 154–288 |
| 50% | 350–600 | 177–316 |
| 90% | 400–700 | 204–371 |
| EP | 450–750 | 232–399 |

Diesel fuels having a clear cetane number (i.e., a cetane number when devoid of any cetane improver such as a peroxy ester) in the range of 30 to 60 are preferred. Particularly preferred are those in which the clear cetane number is in the range of 40 to 50.

The peroxy ester combustion improvers comprise fuel-soluble organic esters containing at least one peroxidized ester linkage in the molecule. The esterifying group is preferably sufficiently hindered sterically as to provide a compound having sufficient stability as to enable it to be handled, shipped, and stored safely without undue hazard. Thus the esterifying alcohol from which the ester is prepared is desirably a secondary alcohol and preferably a tertiary alcohol. Accordingly, the peroxy ester combustion improvers utilized in accordance with this invention may be represented by the general formula $$(R-O-O-\overset{\overset{\displaystyle O}{\|}}{C}-)_nR'$$

wherein R is a hydrocarbyl group, preferably a secondary hydrocarbyl group, and most preferably a tertiary hydrocarbyl group; n is an integer of from 1 to 4, preferably 1 to 3, and more preferably 1 to 2, and most preferably 1; and R′ is a hydrocarbyl group such that when n is 1, R′ is a univalent hydrocarbyl group, when n is 2, R′ is a divalent hydrocarbyl group, when n is 3, R′ is a trivalent hydrocarbyl group, and when n is 4, R′ is a tetravalent hydrocarbyl group.

The hydrocarbyl groups of the peroxy esters are preferably composed solely of carbon and hydrogen. However, they may contain substituent or constituent groups or atoms other than carbon and hydrogen provided such groups do not materially alter the generally hydrocarbonaceous character of the hydrocarbyl group. Thus in addition to comprising aliphatic, cycloaliphatic, or aromatic groups composed solely of carbon and hydrogen, the hydrocarbyl groups may contain inert or innocuous substituents or constituents such as oxygen atoms, nitrogen atoms, sulfur atoms, or combinations thereof. Generally speaking, the hydrocarbyl groups should not contain more than 10% of such substituent or constituent atoms. Preferably the hydrocarbyl groups are secondary alkyl groups and most preferably they are tertiary alkyl groups.

As used herein, the term "fuel-soluble" means that the compound dissolves in the particular distillate fuel being used in an amount at least sufficient to achieve the desired concentration of the peroxy ester.

Suitable peroxy esters are available as articles of commerce and methods for the preparation of peroxy esters are well documented in the literature. Illustrative peroxy esters for use in the practice of this invention include tert-butyl peroxyacetate, tert-butyl peroxypropionate, tert-butyl peroxy-butyrate, tert-butyl peroxyhexanoate, tert-butyl peroxyoctanoate, tert-butyl peroxydecanoate, tert-butyl peroxyundecanoate, tert-butyl peroxydodecanoate, tert-butyl peroxytridecanoate, 1,1-di-methylpropyl peroxyacetate, 1,1-di-methylpropyl peroxyheptanoate, 1,1,3,3-tetramethylbutyl peroxyacetate, 1,1,3,3-tetramethylbutyl peroxypentanoate, 1,1,3,3-tetramethylbutyl peroxyheptanoate, di-(tert-butyl-diperoxy)phthalate, di-(1,1-dimethylpropyldiperoxy)phthalate, tert-butylperoxybenzoate, 1,1-dimethylpropylperoxybenzoate, OO-tert-butyl-O-isopropylmonoperoxycarbonate (available commercially as Lupersol TBICH 75), and the like.

The fuel compositions may additionally contain a small quantity (e.g., up to 5000 ppm and preferably up to 2500 ppm) of one or more organic nitrate esters. These compounds comprise nitrate esters of substituted or unsubstituted aliphatic or cycloaliphatic alcohols which may be monohydric or polyhydric. Preferred organic nitrates are substituted or unsubstituted alkyl or cycloalkyl nitrates having up to about 10 carbon atoms, preferably from 2 to 10 carbon atoms. The alkyl group may be either linear or branched (or a mixture of linear and branched alkyl groups). Specific examples of nitrate compounds suitable for use in the present invention include, but are not limited to, the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentylnitrate, cyclohexyl nitrate, methylcyclohexyl nitrate, isopropylcyclohexyl nitrate, and the like. Also suitable are the nitrate esters of alkoxy substituted aliphatic alcohols such as 2-ethoxyethyl nitrate, 2-(2-ethoxyethoxy)ethyl nitrate, 1-methyloxypropyl-2-nitrate, 4-ethoxybutyl nitrate, etc., as well as diol nitrates such as 1,6-hexamethylene dinitrate, and the like. Preferred are the alkyl nitrates having from 5 to 10 carbon atoms, most especially mixtures of primary amyl nitrates, and mixtures of primary hexyl nitrates.

The concentration of peroxy ester in the fuel can be varied within relatively wide limits with the proviso that the amount employed is at least sufficient to cause a reduction in at least one type of emissions. Generally speaking, the amount employed will fall in the range of about 250 to about 10,000 parts by weight of peroxy ester per million parts by weight of the fuel. Preferred concentrations usually fall within the range of 1,000 to 5,000 parts per million parts of fuel.

In the fuels containing a combination of at least one peroxy ester and at least one organo nitrate, the total concentration of such combination should be sufficient to cause a reduction in at least one type of emissions as compared to the corresponding untreated fuel. Generally speaking, the amount employed will fall in the range of about 250 to 20,000 parts by weight of such combined additives per million parts by weight of fuel. Preferred concentrations usually fall within the range of 1,000 to 10,000 parts per million of fuel. In either case, the fuel should contain at least 250 parts per million of a peroxy ester, the balance of the additive concentration, if any, being organic nitrate.

Other additives may be included within the fuel compositions of this invention provided they do not adversely affect the exhaust emission reductions achievable by the practice of this invention. Thus use may be made of such components as organic hydroperoxides, corrosion inhibitors, antioxidants, antirust agents, detergents and dispersants, friction reducing agents, demulsifiers, dyes, inert diluents, and like materials.

The advantages achievable by the practice of this invention were demonstrated in a sequential series of engine tests in which a Detroit Diesel 11.1 liter Series 60 engine mounted to an engine dynamometer was used. The system was operation on the "EPA Engine Dynamometer Schedule for Heavy-Duty Diesel Engines" set forth at pages 810–819 of Volume 40, Part 86, Appendix I, of the Code of Federal Regulations (7-1-86). In these tests, the first of three consecutive tests involved operation of the engine on a conventional DF-2 diesel fuel having a nominal sulfur content in the range of 2000 to 4000 ppm. This test served as one of two baselines. In the next operation—which represented the practice of this invention—the engine was run using a low-sulfur diesel fuel having the following characteristics with which was blended 5000 ppm of tert-butyl peroxyacetate:

| | |
|---|---|
| Sulfur, ppm | 50 |
| Gravity, API @ 60° F. | 34.7 |
| Pour Point, °F. | −5 |
| Cloud Point, °F. | 8 |
| Copper Strip | 1 |
| Distillation, °F. | |
| IBP | 332 |
| 10% | 430 |
| 50% | 532 |
| 90% | 632 |
| EP | 634 |
| Cetane Number | 43.4 |
| Viscosity @ 40° C., cS | 2.96 |

The third and final test involved another baseline run using the initial conventional DF-2 diesel fuel. In all instances the quantities of $NO_x$, unburned hydrocarbons ("HC"), carbon monoxide ("CO") and particulates emitted by the engine were measured and integrated. The results of these tests are summarized in the following table. The values shown therein for $NO_x$, HC, CO, and Particulates, are presented in terms of grams per brake horsepower per hour. Thus the lower the value, the lower the rate and amount of emissions.

| Test No. | NOx | HC | CO | Particulates |
|---|---|---|---|---|
| 1 | 3.895 | 0.290 | 1.79 | 0.165 |
| 2 | 3.665 | 0.145 | 1.30 | 0.165 |
| 3 | 4.105 | 0.260 | 1.71 | 0.155 |

A further advantageous feature of the fuels of this invention is that the amount of sulfated particulates and sulfur dioxide emitted on combustion of the fuel should, at least in most cases, be significantly less than the amount emitted on combustion of typical present day middle distillate fuels of the same hydrocarbon composition and distillation range.

Methods for reducing the sulfur content of hydrocarbonaceous middle distillate fuels or their precursors are reported in the literature and are otherwise available to those skilled in the art. Among such processes are solvent extraction using such agents as sulfur dioxide or furfural, sulfuric acid treatment, and hydrodesulfurization processes. Of these, hydrodesulfurization is generally preferred, and includes a number of specific methods and operating conditions as applied to various feedstocks. For example, hydrotreating or hydroprocessing of naphthas or gas oils is generally conducted under mild or moderate severity conditions. On the other hand, sulfur removal by hydrocracking as applied to distillate stocks is usually conducted under more severe operating conditions. Vacuum distillation of bottoms from atmospheric distillations is still another method for controlling or reducing sulfur content of hydrocarbon stocks used in the production of hydrocarbonaceous middle distillate fuels. Further information concerning such processes appears in Kirk-Othmer, *Encyclopedia of Chemical Technology,* Second Edition, Interscience Publishers, Volume 11, pages 432–445 (copyright 1966) and references cited therein; Idem., Volume 15, pages 1–77 (copyright 1968) and references cited therein; and Kirk-Othmer, *Encyclopedia of Chemical Technology,* Volume 17, Third Edition, Wiley-Interscience, pages 183–256 (copyright 1982) and references cited therein. All of such publications and cited references are incorporated herein by reference in respect of processes or methods for control or reduction of sulfur content in hydrocarbonaceous middle distillate fuels or their precursor stocks.

Another method which can be used involves treatment of the hydrocarbonaceous middle distillate fuel with a metallic desulfurization agent such as metallic sodium, or mixtures of sodium and calcium metals.

This invention is susceptible to considerable variation in its practice without departing from the spirit and scope of the ensuing claims.

What is claimed is:

1. A fuel composition comprising a major proportion of a hydrocarbonaceous middle distillate base fuel which has a sulfur content of less than 500 ppm and a minor emission reducing amount of at least one peroxy ester combustion improver dissolved therein wherein the middle distillate base fuel is further characterized by having a clear cetane number in the range of 30 to 60.

2. A composition as claimed in claim 1 wherein the sulfur content of the base fuel is 100 ppm or less.

3. A composition as claimed in claim 1 wherein the base fuel is further characterized by having the following distillation profile:

| | °F. | °C. |
|---|---|---|
| IBP | 250–500 | 121–260 |
| 10% | 310–550 | 154–288 |
| 50% | 350–600 | 177–316 |
| 90% | 400–700 | 204–371 |
| EP | 450–750 | 232–399 |

4. A composition as claimed in claim 1 wherein the base fuel has a sulfur content of 100 ppm or less and the following distillation profile:

| | °F. | °C. |
|---|---|---|
| IBP | 250–500 | 121–260 |
| 10% | 310–550 | 154–288 |
| 50% | 350–600 | 177–316 |
| 90% | 400–700 | 204–371 |
| EP | 450–750 | 232–399 |

5. A composition as claimed in claim 1 wherein the base fuel has a sulfur content of 100 ppm or less and is further characterized by having a clear cetane number in the range of 40 to 50.

6. A composition as claimed in any of claims 1, 2, 3, 4, and 5 wherein the peroxy ester combustion improver consists essentially of a fuel-soluble tertiary alkyl peroxy ester of an aliphatic or cycloaliphatic or aromatic acid.

7. A composition as claimed in any of claims 1, 2, 3, 4 and 5 wherein the peroxy ester combustion improver consists essentially of a fuel-soluble tertiary butyl peroxy ester of an aliphatic or cycloaliphatic or aromatic acid.

8. A composition as claimed in any of claims 1, 2, 3, 4 and 5 wherein the peroxy ester combustion improver consists essentially of tert-butyl peroxyacetate.

9. A composition as claimed in any of claims 1, 2, 3, 4 and 5 wherein said fuel contains an amount of said peroxy ester falling in the range of 250 to 10,000 parts by weight per million parts by weight of said fuel.

10. A composition as claimed in any of claims 1, 2, 3, 4 and 5 wherein said fuel contains 1,000 to 5,000 parts by weight of at least one fuel-soluble tertiary alkyl peroxy ester of an aliphatic or cycloaliphatic or aromatic acid per million parts by weight of said fuel.

11. A composition as claimed in any of claims 1, 2, 3, 4 and 5 wherein said fuel contains 1,000 to 5,000 parts by weight of at least one fuel-soluble tertiary butyl peroxy ester of an aliphatic or cycloaliphatic or aromatic acid.

12. A composition as claimed in any of claims 3, 4, and 5 wherein said fuel contains 1,000 to 5,000 parts by weight of tert-butyl peroxyacetate.

13. The fuel composition of claim 1 further comprising a combustion improving amount of one or more organic nitrate esters.

14. The fuel composition of claim 13 wherein the organic nitrate ester is 2-ethylhexyl nitrate.

15. The fuel composition of claim 1 wherein said fuel contains 1,0000 to 5,000 parts by weight of tert-butyl peroxyacetate and further comprising up to 5000 ppm of one or more organic nitrate esters of substituted or unsubstituted aliphatic or cyloaliphatic alcohols.

16. The fuel composition of claim 15 wherein the organic nitrate ester is 2-ethylhexyl nitrate.

17. In a combustion process wherein a middle distillate fuel is subjected to combustion in the presence of air, the improvement which comprises providing as the fuel used in such process a hydrocarbonaceous middle distillate base fuel having a sulfur content of less than 500 ppm and a clear cetane number in the range of 30 to 60, said fuel having dissolved therein a minor emission reducing amount of at least one peroxy ester combustion improver.

18. The improvement in accordance with claim 17 wherein the combustion is effected within the combustion chamber of a compression ignition engine being operated on a diesel fuel composition comprising (i) a major proportion of a hydrocarbonaceous middle distillate base fuel having a sulfur content of 100 ppm or less, and (ii) a minor combustion improving amount of at least one peroxy ester of at least one aliphatic or cycloaliphatic or aromatic acid.

19. The improvement as claimed in claim 17 wherein the peroxy ester combustion improver consists essentially of a fuel soluble tertiary alkyl peroxyester of an alkanoate acid.

20. In a process for the production of a hydrocarbonaceous middle distillate fuel, the improvement which comprises controlling the sulfur content of the fuel to a level of 500 ppm or less and blending an emission reducing amount of at least one peroxy ester combustion improver with the resultant reduced sulfur-containing fuel wherein said fuel is further characterized by having a clear cetane number in the range of 30 to 60.

21. In the operation of a motor vehicle which operates on middle distillate fuel, the improvement which comprises fueling the vehicle with a hydrocarbonaceous middle distillate fuel characterized by (i) having a sulfur content of less than 500 ppm, (ii) a clear cetane number in the range of 30 to 60, and (iii) containing a minor emission reducing amount of at least one peroxy ester combustion improver dissolved therein.

22. In the operation of aircraft which operates on middle distillate fuel, the improvement which comprises fueling the aircraft with a hydrocarbonaceous middle distillate fuel characterized by (i) having a sulfur content of less than 500 ppm, (ii) a clear cetane number in the range of 30 to 60, and (iii) containing a minor emission reducing amount of at least one peroxy ester combustion improver dissolved therein.

* * * * *